US005432952A

United States Patent [19]

Tate

[11] Patent Number: 5,432,952

[45] Date of Patent: Jul. 18, 1995

[54] COMPOUND BIB AND METHOD OF USING SAME

[76] Inventor: Kathleen M. Tate, 35126 Kensington, Sterling Heights, Mich. 48312

[21] Appl. No.: 327,294

[22] Filed: Oct. 21, 1994

[51] Int. Cl.[6] ..... A41B 13/10

[52] U.S. Cl. ..... 2/49.4; 2/46; 2/49.1; 2/119; 2/120

[58] Field of Search ..... 2/46, 48, 49.1, 49.2, 2/, 49.3, 49.4, 49.5, 50, 51, 52, 69, 69.5, 75, 80, 83, 104, 105, 106, 113, 114, 115, 118, 119, 120, 121

[56] References Cited

U.S. PATENT DOCUMENTS

| | | | |
|---|---|---|---|
| 439,736 | 11/1890 | Webber | 2/49.5 |
| 1,556,468 | 10/1925 | Alamo | 2/50 |
| 2,110,544 | 3/1938 | Dauphin | 2/50 |
| 2,152,073 | 3/1939 | McEldowney | 2/48 |
| 2,523,565 | 9/1950 | Gardner . | |
| 4,442,552 | 4/1984 | Bolick et al. . | |
| 4,475,250 | 10/1984 | Savin et al. | 2/49.1 |
| 5,036,547 | 8/1991 | Silas | 2/46 |

FOREIGN PATENT DOCUMENTS

| | | | |
|---|---|---|---|
| 2430203 | 3/1980 | France | 2/49.4 |
| 2591077 | 6/1987 | France | 2/49.4 |
| 2153142 | 10/1971 | Germany | 2/48 |

*Primary Examiner*—Jeanette E. Chapman
*Attorney, Agent, or Firm*—Peter D. Keefe

[57] ABSTRACT

A compound bib having a primary bib member for protecting the exterior surface of garments at the chest of the bib wearer and a secondary bib member for protecting the chest and adjacent front neck area under surface of the garments of the wearer from spill soilage. Preferably, both the primary bib member and the secondary bib member are each a laminate composed of a liquid absorbent outer layer and a liquid impermeable inner layer. In use, the secondary bib member is tucked under all the garments of the wearer so that it lies adjacent the front of the neck and abutting the chest skin of the wearer. Accordingly, in the event a spill runs down the neck of the wearer, the secondary bib member will serve as a shield thereagainst with respect to the wearer's garments.

5 Claims, 1 Drawing Sheet

COMPOUND BIB AND METHOD OF USING SAME

BACKGROUND OF THE INVENTION

1. Field of the invention

The present invention relates to bibs, and more particularly to a compound bib having a primary bib member which serves to protect the exterior surface of garments worn in the vicinity of the chest of the bib wearer and a secondary bib member which serves to protectively cover the under surface of the garments from the adverse effects of spills at the front neck and chest area of the bib wearer.

2. Description of the Prior Art

Bibs are worn by children and adults for the same basic reason: they serve as a shield against soiling of garments, such as when foods are being eaten of a type which may entail the possibility of spillage or when dental procedures are being performed. Conventional bibs are formed of an apron-like member which is sized to fit over the chest area of the garments of the wearer and further includes a pair of tie members which mutually encircle the wearer's neck and are thereupon tied together to hold the apron-like member in place. The apron-like member may include disposable or nondisposable materials, and is frequently constructed of cloth, paper or plastic material.

Problematically, a conventional bib does not protect the bib wearer from the effects of running spills which run down the neck of the bib wearer and pass underneath the apron-like member at the wearer's neck. In such a case, the spill would encounter the under surface of the garments of the bib wearer regardless of whether or not a bib is being worn.

Examples of interesting bibs are described in U.S. Pat. No. 4,442,552 to Bolick et al, dated Apr. 17, 1984 and U.S. Pat. No. 2,523,565 to Gardner, dated Sep. 26, 1950.

The Bolick et al disclosure is related to providing a good, secure fit of a bib with respect to a wearer without need of ties or other connection members. Bolick et al accomplish this by providing a bib having a triangularly shaped cut-out through which the wearer's head and neck project, wherein the bib lies over the shoulders and extends over the upper back of the wearer. The material of the cut-out may be doubled over at the chest of the wearer or may be removed entirely. A preferred bib material is a laminate of an absorbent fiber sheet on either or both sides of a spunbonded nonwoven sheet or on one side of a water impervious film of polyethylene, polypropylene or the like. While Bolick et al teach folding over the cut-out material to provide a double layer of protection, it is respectfully submitted that there is no mention of how to prevent running drips from soiling the under surface of the wearer's garment next to the skin.

The Gardner disclosure is also related to providing a good, secure fit of a bib with respect to the wearer without resort to ties or other connection members. Gardner accomplishes this by providing a bib having a body portion and a tuck-in member connected with the body portion. The body portion has a neck cut-out and the tuck-in member is structured to be tucked under a wearer's garment about the entire circumference of the wearer's neck. The material of the bib may be a laminate. While Gardner teaches tucking of a tuck-in member under a garment of a wearer, this, it is respectfully submitted, is only for the purpose of holding the bib in proper position with respect to the wearer. For example, it is possible that the tuck-in member might be tucked under a shirt but not under an undershirt that is also being worn, yet the bib might just as well be held in place.

Accordingly, there still remains unanswered the problem of how a bib may be structured and used so as to prevent running drips from soiling either or both the exterior surface and under surface of the garments of a wearer adjacent the front neck and chest area of the wearer.

SUMMARY OF THE INVENTION

The present invention is a bib which has a primary bib member for protecting the exterior surface of garments at the chest of the bib wearer and a secondary bib member for protecting the under surface of the garments of the wearer from spill soilage adjacent the front neck and the chest.

The compound bib according to the present invention includes a primary bib member having a preselected apron-like shape for covering the chest area of the wearer so as to protect from soilage the exterior surface of garments being worn by the wearer. The primary bib member has a neck contour for accommodatingly conforming to the shape of the neck of the wearer and further has a connection mechanism for placing the neck contour at the neck of the user to thereby secure the compound bib with respect to the wearer. The compound bib according to the present invention further includes a secondary bib member which is connected with the primary bib member continuously along the neck contour. The secondary bib member wraps over and under all the garments of the wearer located at the front neck and chest area to protect the garments from running spills which run down the neck of the wearer and would otherwise soil the under surface of the garments.

Preferably, the primary bib member of the compound bib is a laminate composed of a liquid absorbent outer layer and a liquid impermeable inner layer, such as for example provided by a plastic inner layer and a cloth outer layer, wherein the two layers are everywhere mutually interconnected. Preferably further, the secondary bib member of the compound bib is structured similarly to the primary bib member, wherein the outer layer thereof (the layer thereof facing the skin of the wearer) is a liquid absorbent layer, while the inner layer thereof (the layer thereof facing the primary bib member) is a liquid impermeable layer.

In use, the secondary bib member is tucked under all the garments of the wearer so that it lies adjacent the front neck and abutting the skin of the chest of the wearer. Accordingly, in the event a spill runs down the neck of the wearer, the secondary bib member will serve as a shield thereagainst with respect to the wearer's garments.

These, and additional objects, advantages, features and benefits of the present invention will become apparent from the following specification.

BRIEF DESCRIPTION OF TEE DRAWINGS

DETAILED DESCRIPTION OF THE PREFERRED EMBODIMENT

Figure 1:
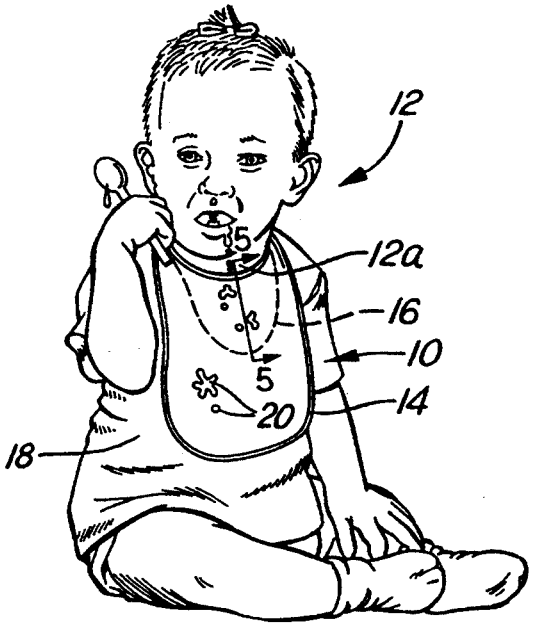
FIG. 1 is a perspective view of the compound bib according to the present invention, shown in operation with respect to a wearer.
Figure 5:
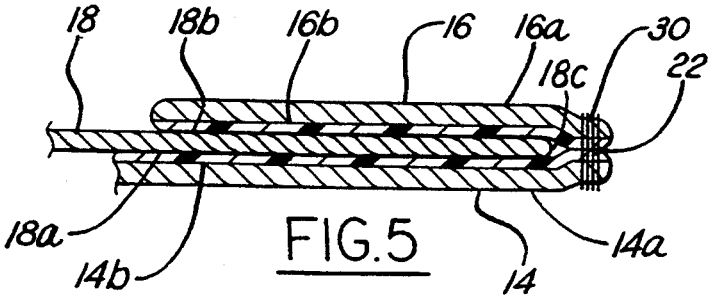
FIG. 5 is a sectional end view of the compound bib according to the present invention, shown in operation and seen along line 5—5 in FIG. 1.

Referring now to the Drawing, FIGS. 1 and 5 show the compound bib 10 according to the present invention in operation with respect to a wearer 12. While the wearer 12 shown in FIG. 1 is by example a child, it is to be understood that the compound bib 10 according to the present invention may be worn by any wearer of any age, from new born to senior citizen. The compound bib 10 is composed of two cooperating members: a primary bib member 14 and a secondary bib member 16. The primary bib member 14 serves to shieldingly protect the exterior surface 18*a* of the garments 18 of the wearer 12 from becoming soiled at the chest area thereof due to drippings 20. The secondary bib member 16 wraps over all the garments 18 at the front portion of the neck 12*a* of the wearer 12, thereby shieldingly protecting the under surface 18*b* of the garments from becoming soiled at the front neck and chest area of the wearer.

The primary bib member 14 has a preselected shape and size which is appropriate for the wearer, as for example a small size and shape for covering the chest area of a baby or a large size and shape for covering the chest area of a full grown adult. Preferably, the primary bib member 14 is a laminate composed of a liquid absorbent outer layer 14*a* and a liquid impermeable inner layer 14*b*, as depicted in FIG. 5. For example, the outer layer 14*a* may be structured of a towel-like cloth material, while the inner layer 14*b* may be structured of a plastic sheet material that is bonded to the cloth material, or structured of a plastic coating that is applied to the outer layer. The compound bib 10 is configured so that the inner layer 14*b* faces toward the garments 18 of the wearer. This laminate structure, while not being required, is preferred because the inner layer 14*b* serves to prevent liquids from penetrating through the primary bib member 14, while the outer layer 14*a* slows and eventually absorbs spills as they run down the primary bib member 14.

Figure 2:
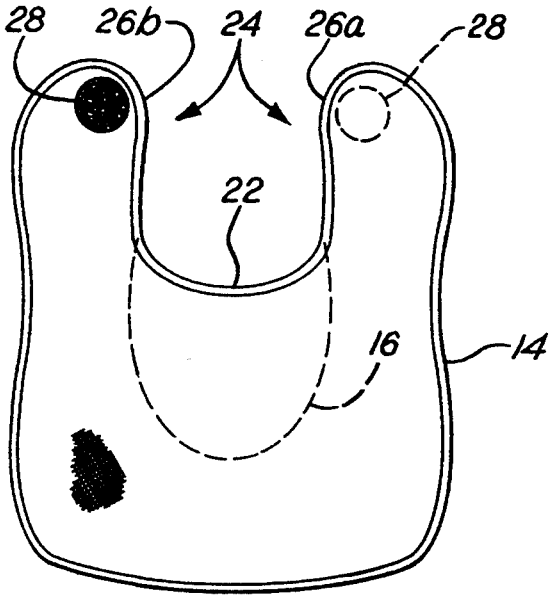
FIG. 2 is a top plan view of the compound bib according to the present invention, shown with the connection mechanism thereof not operating.
Figure 3:
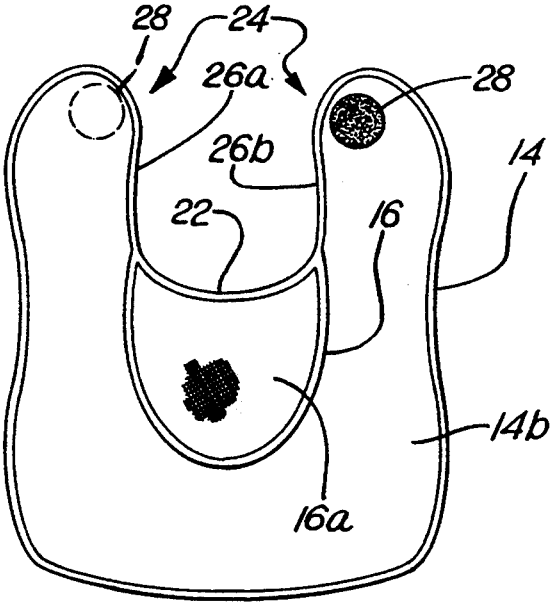
FIG. 3 is a rear plan view of the compound bib according to the present invention, shown with the connection mechanism thereof not operating.
Figure 4:
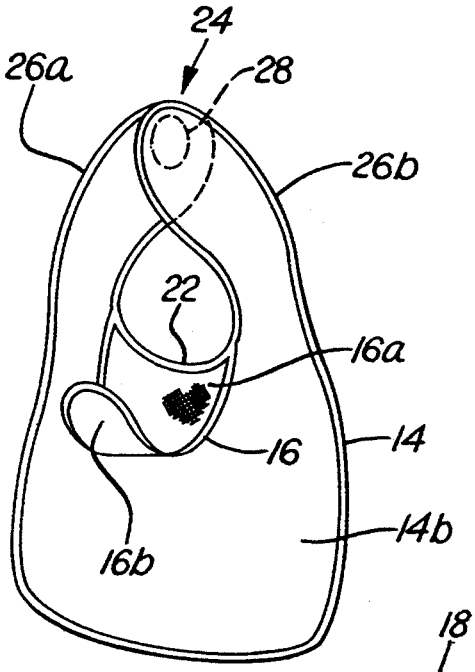
FIG. 4 is a rear perspective view of the compound bib according to the present invention, shown with the connection mechanism thereof operating.

The primary bib member 14 is provided with a neck contour 22 for abutting the front neck area 12*a* of the wearer 12. Connected with the primary bib member 14 is a connection mechanism 24 for releasably securing the compound bib 10 to the neck of the user in a manner that obviates tucking of the secondary bib member 16 anywhere other than at the front neck area. A preferred example of connection mechanism 24 is in the form of first and second extension arms 26*a*, 26*b* located at either side of the neck contour 22, wherein the distal ends of the first and second arms are provided with a releasable connection device 28, such as a cooperating button and button hole, a pair of cooperating male and female snap fasteners, or a pair of cooperating VELCRO fasteners (VELCRO is a trademark of Velcro, USA), as shown in FIGS. 2 through 4. As shown in FIG. 4, the extension arms 26*a*, 26*b* are contoured to abut the neck of the wearer when the compound bib 10 is in place upon the wearer's neck; and as shown in FIG. 1, the extension arms further serve to protectively cover at least a portion of the shoulders of the wearer. Other forms of connection mechanism may be substituted for the connection mechanism 24 that is shown in the Drawings. For example ties can be substituted for the first and second extension arms 26*a*, 26*b*, wherein the ties are mutually tied together to thereby secure the compound bib 10 to the wearer's neck.

The secondary bib member 16 has a preselected size and shape which allows it to be wrapped over the upper end 18*c* of all the garments 18 that are located at the front neck and chest area, and thereupon be tucked under the under surface 18*b* of the garments. The area of the secondary bib member 16 is selected to permit it to be easily tucked under the garments 18 and yet ensure that spills which run down the front of the neck are prevented from encountering the under side 18*b* of the garments. For example, a compound bib 10 structured for use by a toddler may have a secondary bib member 16 on the order of about fifty percent, more or less, the size of the primary bib member 14, whereas a compound bib structured for use by a full grown adult may have a secondary bib member on the order of about twenty-five percent, more or less, the size of the primary bib member. As shown in the Drawing, the secondary bib member 16 is preferred to have an elliptically curved shape facing away from the neck contour 22, wherein its greatest elongation coincides with an imaginary line symmetrically bisecting the compound bib 10 midway between the first and second extension arms 26*a*, 26*b*.

As indicated in FIG. 5, the secondary bib member 16 is secured to the primary bib member 14 at the neck contour 22 by any suitable fastening methodology, such as by bonding or sewing 30; alternatively, the secondary bib member may be integrally formed with the primary bib member. The connection between the primary bib member 14 and the secondary bib member 16 must be continuous along the neck contour 22 so that the compound bib 10 will protect the upper end 18*c* of the garments all across the front of the neck.

It is also preferred for the secondary bib member 16 to be of a laminate construction similar to that of the primary bib member 14. In this regard, the liquid absorbent layer 16*a* thereof is located so as to face toward the skin of the wearer, while the liquid impermeable layer 16*b* thereof faces toward the garments 18 when the compound bib 10 is worn, as shown in FIG. 5. In this way, the liquid absorbent layer 16*a* will impede and absorb spills, while the liquid impermeable layer 16*b* will prevent the spill from contacting the garments therethrough.

In operation, the wearer (or the wearer's companion or guardian) places the compound bib upon the chest area of the wearer so that the neck contour is adjacent the front neck area of the wearer. The secondary bib member is tucked under all the garments worn at the front neck area and upper chest of the wearer so that the secondary bib member abuts the skin of the front neck and upper chest of the wearer. The connection member is then manipulated so that it is in its operational mode wherein the compound bib is securely held in place with respect to the wearer.

If any drippings splatter upon the primary bib member, they are shielded from soiling the garments of the wearer. If any spillage runs down the front of the neck and/or chest of the wearer, the secondary bib member shields the garments of the wearer from soilage thereby.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A compound bib for being located at the chest of a wearer for protecting garments worn adjacent the neck and upper chest of the wearer from becoming soiled by spillage, comprising:

a primary bib member structured for protectively covering the chest of a wearer, said primary bib member having a neck contour for being located at the front of the neck of the wearer;

a secondary bib member connected with said primary bib member continuously along said neck contour, said secondary bib member being structured to cover any garments worn by the wearer at the neck and upper chest; and connection mechanism means for holding said primary and secondary bib members in a preselected placement with respect to the neck of the wearer, said connection mechanism means comprising:

a first extension arm connected to said primary bib member at a first side of said neck contour, said first extension arm having a first distal end;

a second extension arm connected to said primary bib member at a second side of said neck contour, said second extension member having a second distal end; and releasable connection device means connected with said first and second extension arms for selectively connecting together said first and second distal ends of said first and second extension arms;

wherein said primary bib member is a laminate comprising:

a primary bib member outer layer composed of a liquid absorbing material; and a primary bib member inner layer composed of a liquid impermeable material, said primary bib member inner layer being interconnected with said primary bib member outer layer;

wherein said secondary bib member is a laminate comprising:

a secondary bib member outer layer composed of a liquid absorbing material; and a secondary bib member inner layer composed of a liquid impermeable material, said secondary bib member inner layer being interconnected with said secondary bib member outer layer;

wherein when said compound bib is worn by the wearer, said primary bib member inner layer and said secondary bib member inner layer each face toward each other and any garments of the wearer worn at the chest and adjacent the front neck thereof.

2. The compound bib of claim 1, wherein said secondary bib member has an elliptically curved shape facing away from said neck contour.

3. A compound bib for being located at the chest of a wearer for protecting garments worn adjacent the neck and upper chest of the wearer from becoming soiled by spillage, comprising:

a primary bib member structured for protectively covering the chest of a wearer, said primary bib member having a neck contour for being located at the front of the neck of the wearer, said primary bib member being a laminate comprising:

a primary bib member outer layer composed of a liquid absorbing material; and a primary bib member inner layer composed of a liquid impermeable material, said primary bib member inner layer being interconnected with said primary bib member outer layer;

a secondary bib member connected with said primary bib member continuously along said neck contour, said secondary bib member being structured to cover any garments worn by the wearer at the neck and upper chest, said secondary bib member being a laminate comprising:

a secondary bib member outer layer composed of a liquid absorbing material; and a secondary bib member inner layer composed of a liquid impermeable material, said secondary bib member inner layer being interconnected with said secondary bib member outer layer; and connection mechanism means for holding said primary and secondary bib members in a preselected placement with respect to the neck of the wearer;

wherein when said compound bib is worn by the wearer, said primary bib member inner layer and said secondary bib member inner layer each face toward each other and any garments of the wearer worn at the chest and adjacent the front neck thereof.

4. The compound bib of claim 3, wherein said connection mechanism means comprises:

a first extension arm connected to said primary bib member at a first side of said neck contour, said first extension arm having a first distal end;

a second extension arm connected to said primary bib member at a second side of said neck contour, said second extension member having a second distal end; and releasable connection device means connected with said first and second extension arms for selectively connecting together said first and second distal ends of said first and second extension arms.

5. The compound bib of claim 4, wherein said secondary bib member has an elliptically curved shape facing away from said neck contour.

* * * * *